US007870911B2

(12) United States Patent
Yoshida et al.

(10) Patent No.: US 7,870,911 B2
(45) Date of Patent: Jan. 18, 2011

(54) PILE DRIVER

(75) Inventors: Shigemitsu Yoshida, Nagoya (JP); Nobuyuki Tomida, Nagoya (JP)

(73) Assignee: Nippon Sharyo, Ltd., Nagoya-shi (JP)

( * ) Notice: Subject to any disclaimer, the term of this patent is extended or adjusted under 35 U.S.C. 154(b) by 135 days.

(21) Appl. No.: 12/292,777

(22) Filed: Nov. 26, 2008

(65) Prior Publication Data

US 2009/0133891 A1 May 28, 2009

(30) Foreign Application Priority Data

Nov. 27, 2007 (JP) ..... 2007-305598

(51) Int. Cl.
*E02D 7/06* (2006.01)

(52) U.S. Cl. ..... 173/185; 173/193; 173/184; 173/42; 173/90

(58) Field of Classification Search ..... 173/185, 173/193, 184, 42, 90
See application file for complete search history.

(56) References Cited

U.S. PATENT DOCUMENTS 1,787,000 A * 12/1930 Hunt ..... 405/249
2,392,061 A * 1/1946 Pfeiffer ..... 91/216 B
3,115,198 A * 12/1963 Kuss ..... 173/127
3,446,284 A * 5/1969 Dyer et al. ..... 173/164
3,741,322 A * 6/1973 Wolters ..... 175/52
3,994,350 A * 11/1976 Smith et al. ..... 175/85
4,124,081 A * 11/1978 Deike ..... 173/28
4,595,065 A * 6/1986 Wada et al. ..... 175/85
5,653,556 A * 8/1997 White ..... 405/249
5,660,504 A * 8/1997 Reinert, Sr. ..... 405/232
5,944,452 A * 8/1999 Reinert, Sr. ..... 405/232
6,598,683 B1 * 7/2003 Ultimo et al. ..... 173/1
7,695,217 B2 * 4/2010 Hessels et al. ..... 405/232

FOREIGN PATENT DOCUMENTS

JP 58-195624 11/1983
JP 61-89040 6/1986

* cited by examiner

*Primary Examiner*—Brian D Nash
(74) *Attorney, Agent, or Firm*—Edwards Angell Palmer & Dodge LLP

(57) ABSTRACT

A pile driver includes a leader rotation/holding mechanism that can firmly hold a leader in a rotatable state and also reliably rotate the leader using a general-purpose, inexpensive hydraulic motor by keeping the hydraulic motor from action of a bending moment from the leader. The pile driver has a leader revolver that includes a mechanism for rotating a leader. The leader revolver includes an outer tube and an inner tube that is concentrically arranged inside the outer tube via a pair of tapered roller bearings provided at two upper and lower positions. A lower part of the leader is connected, in an integrally rotatable state, to an upper part of the inner tube protruding upward from an upper end opening of the outer tube. A hydraulic motor is placed in a lower part of the leader revolver.

15 Claims, 9 Drawing Sheets

PILE DRIVER

BACKGROUND OF THE INVENTION

1. Field of the Invention

The present invention relates to a pile driver, and in particular relates to a structure of a leader revolver that is a leader support device including a mechanism for rotating a rotary leader provided in a pile driver.

2. Description of the Related Art

A pile driver including a rotary leader that is supported rotatably about an axis is known for use in auger-hammer combined operations and sheet/multiaxial method operations. As a structure for rotatably supporting the leader and also rotating the leader, the leader is divided into an upper leader and a bottom leader and a hydraulic actuator is provided between the upper and the bottom leader to rotate the upper leader. Known systems for rotatably supporting the upper leader by the bottom leader include a system in which the upper leader and the bottom leader are simply connected together via a ball bearing, and a system in which a casing flange (fixed flange) of a hydraulic motor including a speed reducer is connected to an upper part of the bottom leader and a rotary case flange (movable flange) of the hydraulic motor is connected to a lower part of the upper leader (for example, see Japanese unexamined Patent Publication (Kokai) No. Sho 58-195624). In addition, there is also a known system in which a subleader is mounted on a front part of a base machine and a main leader is rotatably supported by leader holders provided at the top and bottom of the subleader, with a leader rotation device being incorporated in the bottom leader holder (for example, see Japanese Unexamined Utility Model Registration Publication (Kokai) No. Sho 61-89040).

In the leader support system that is eccentric to the center of the leader, when a large bending moment is applied to the leader, there is a danger that an excessive load acts on the ball bearing or the flange of the hydraulic motor and impairs its function or causes damage. Moreover, in the system where the upper and lower flanges of the hydraulic motor including the speed reducer are connected respectively to the upper and bottom leaders, it is extremely difficult, with strength of a typical hydraulic motor, to tolerate a large bending moment applied to the upper leader. Therefore, a general-purpose hydraulic motor cannot be used, and a special, expensive hydraulic motor is necessary. For example, a vane hydraulic motor is used as a means for rotating the upper leader while firmly holding the upper leader. However, a large vane hydraulic motor has a problem that much labor is required for polishing to ensure accuracy. Hence increase in cost cannot be avoided in this case, too.

SUMMARY OF THE INVENTION

An objective of the present invention is to provide a pile driver including a leader rotation/holding mechanism that can firmly hold a leader in a rotatable state and also reliably rotate the leader using a general-purpose, inexpensive hydraulic motor by keeping the hydraulic motor from action of a bending moment from the leader.

In a first aspect of the present invention, the pile driver holds at a front part of a base machine a leader rotatably about an axis. The base machine is provided with a leader revolver having a rotation means for holding the leader rotatably and also rotating the leader. The leader revolver includes a fixed-side outer tube connected to the base machine; a rotation-side inner tube concentrically arranged inside the fixed-side outer tube via a pair of bearings which are disposed at two upper and lower positions. A lower part of the leader is connected, in an integrally rotatable state, to an upper part of the rotation-side inner tube that protrudes upward from an opening at an upper end of the fixed-side outer tube, and a hydraulic motor is disposed at a lower part of the leader revolver. One of a fixed flange and a movable flange of the hydraulic motor is connected to a lower part of the rotation-side inner tube, and the other one of the fixed flange and the movable flange is connected to a lower part of the fixed-side outer tube.

In a second aspect according to the first aspect of the present invention, a bottom leader holder that holds a bottom leader rotatably about an axis is provided at a lower part of the fixed-side outer tube via a bearing member, and the leader and the bottom leader holder are connected to each other by a guide pipe in an integrally rotatable state. In a third aspect according to the second aspect of the present invention, the bottom leader holder is provided with a disc that integrally rotates with the bottom leader holder, and a locking means that locks rotation of the disc by clamping the disc is disposed at a lower part of the fixed-side outer tube. In a forth aspect according to the first aspect of the present invention, the connection between the flange of the hydraulic motor and the lower part of the fixed-side outer tube is made by projection-depression engagement of a plurality of circumferentially formed projections and depressions. In a fifth aspect according to the first aspect of the present invention, the hydraulic motor includes a negative brake.

In a sixth aspects according to the first to fifth aspects of the present invention, the leader revolver is supported on the base machine via a subleader that is provided on a base machine side of the leader in parallel with the leader. In a seventh according to the first to fifth aspects of the present invention, a main shaft provided on a rear side of the leader of the leader revolver is supported by an arm that is formed on the base machine.

In the pile driver according to the present invention, the leader is integrally connected to the upper part of the rotation-side inner tube of the leader revolver in which the fixed-side outer tube and the rotation-side inner tube are rotatably formed via one pair of bearings. Thus, even when a large bending moment is applied to the leader, the leader can be reliably held by the leader revolver in a rotatable state. In addition, by allowing clearance between the circumferentially formed projections and depressions in the projection-depression engagement for the fixed flange of the hydraulic motor placed in the lower part of the leader revolver, it is possible to prevent action of a bending moment from the leader. Accordingly, a general-purpose, inexpensive hydraulic motor can be used. Furthermore, since a large load does not act on the hydraulic motor, the hydraulic motor can be expected to operate stably over a long period of time. This allows for reductions in manufacturing cost and maintenance/inspection cost.

DETAILED DESCRIPTION OF THE PREFERRED EMBODIMENTS

Figure 1:
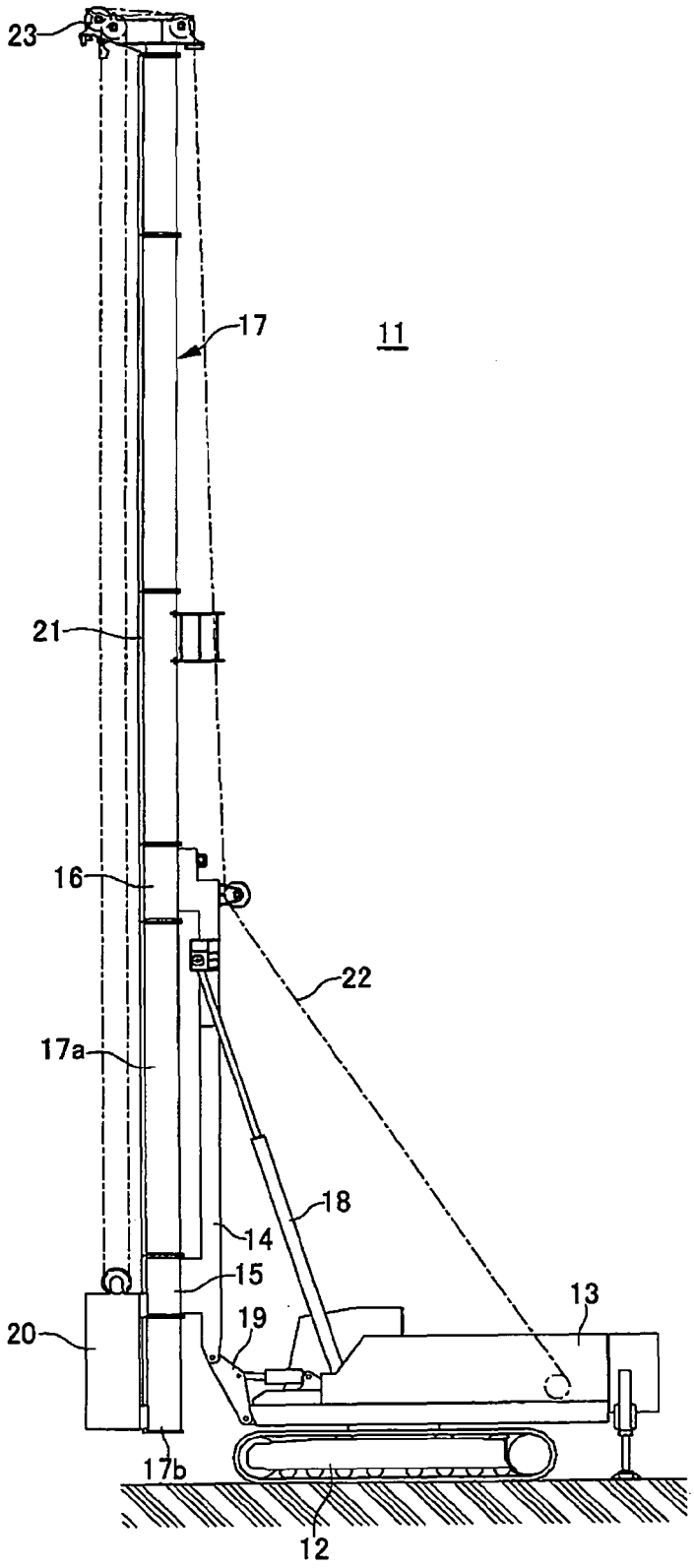
FIG. 1 is a schematic side view showing an embodiment of a pile driver according to the present invention.

The following describes an embodiment of a pile driver according to the present invention in detail, with reference to FIGS. 1 to 7. As shown in FIG. 1, a pile driver 11 in this embodiment includes: a traveling section 12 having a crawler; a base machine 13 rotatably mounted on the traveling section 12; a subleader 14 erectably provided at the front of the base machine 13; a leader revolver 15 supported by a lower part of the subleader 14 and including a leader rotation mechanism; a leader holder 16 supported by an upper part of the subleader 14; a leader 17 attached to the leader revolver 15 and the leader holder 16; and one pair of left and right leader erect cylinders 18 that support the subleader 14 from behind.

A leader support link 19 for supporting the lower part of the subleader 14 is provided at the front of the base machine 13. A hydraulic unit for driving a working device 20 such as an auger attached to the leader 17 and driving a hydraulic motor or a hydraulic cylinder is provided at the rear of the base machine 13.

The leader 17 is divided into an upper leader 17*a* and a bottom leader 17*b* with the leader revolver 15 therebetween. The upper leader 17*a* has its small diameter portion passing through the above leader holder 16 and extends upward in a rotatable state. A guide member 21 for guiding the working device 20 is situated in front of the leader 17 throughout its length. A top sheave 23 for guiding a wire 22 which is let out from a winch of the hydraulic unit is mounted on top of the leader 17. One pair of left and right guide bars 24 for movably guiding the leader 17 in an axial direction with respect to the subleader 14 are situated on both sides of the upper leader 17*a* (see FIGS. 2 and 3). A hydraulic hose 25 is placed under the subleader 14 (see FIG. 3).

Figure 2:
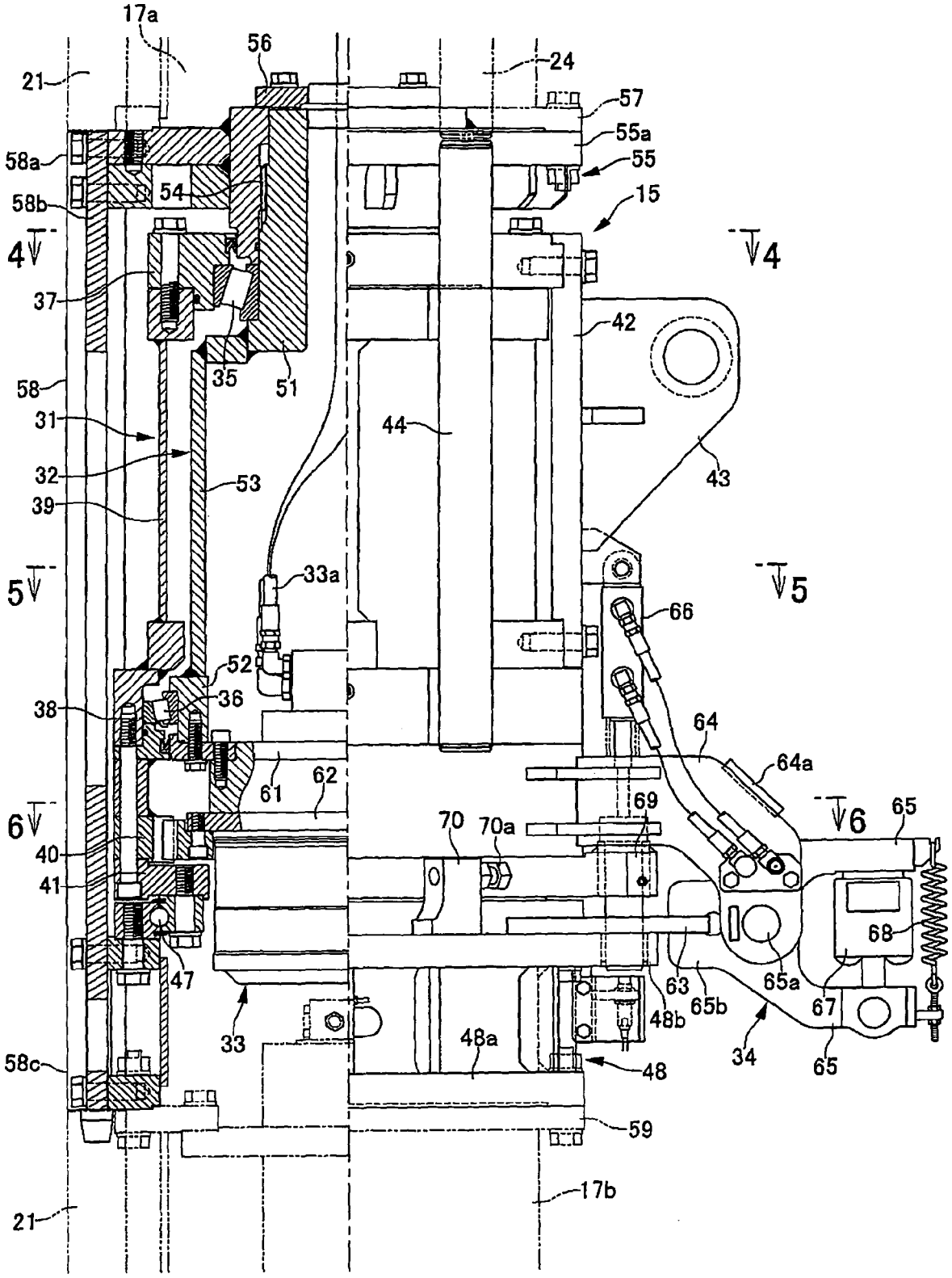
FIG. 2 is a partially sectional side view showing an embodiment of a leader revolver used in the pile driver according to the present invention.
Figure 3:
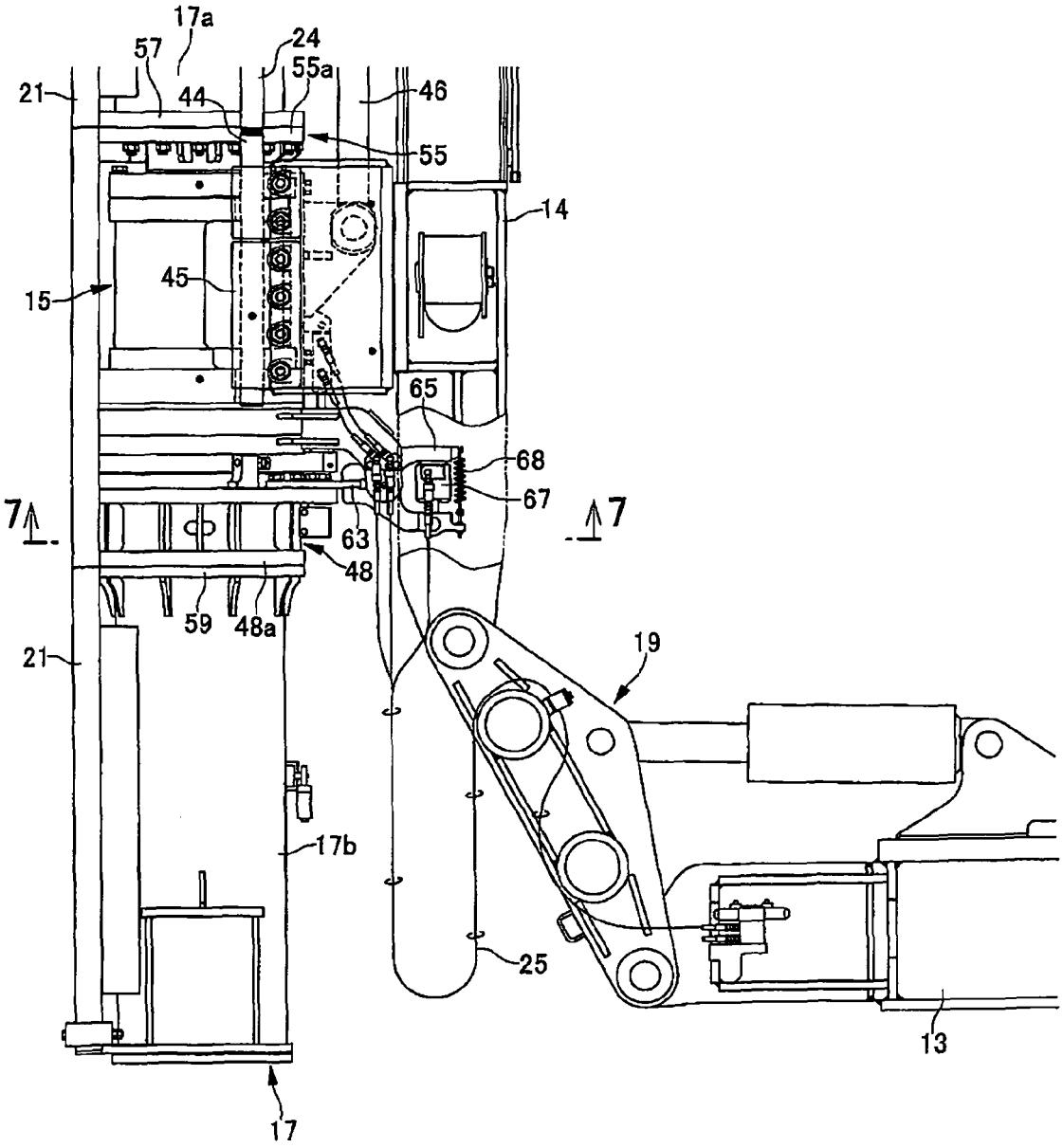
FIG. 3 is a side view of the relevant part showing a leader lower end part of the pile driver according to the present invention.
Figure 4:
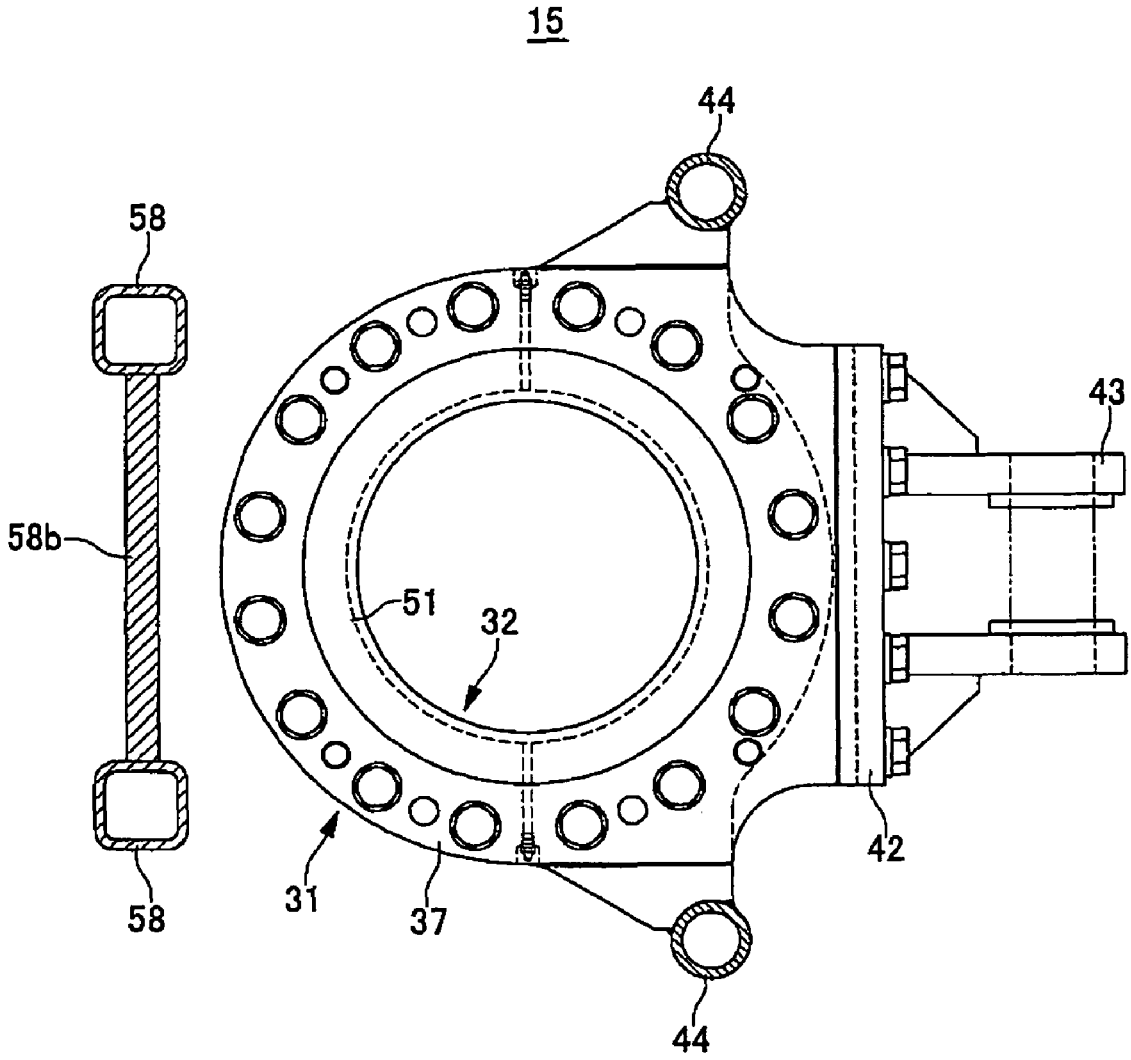
FIG. 4 is a cross-sectional view taken along the line 4-4 in FIG. 2.
Figure 5:
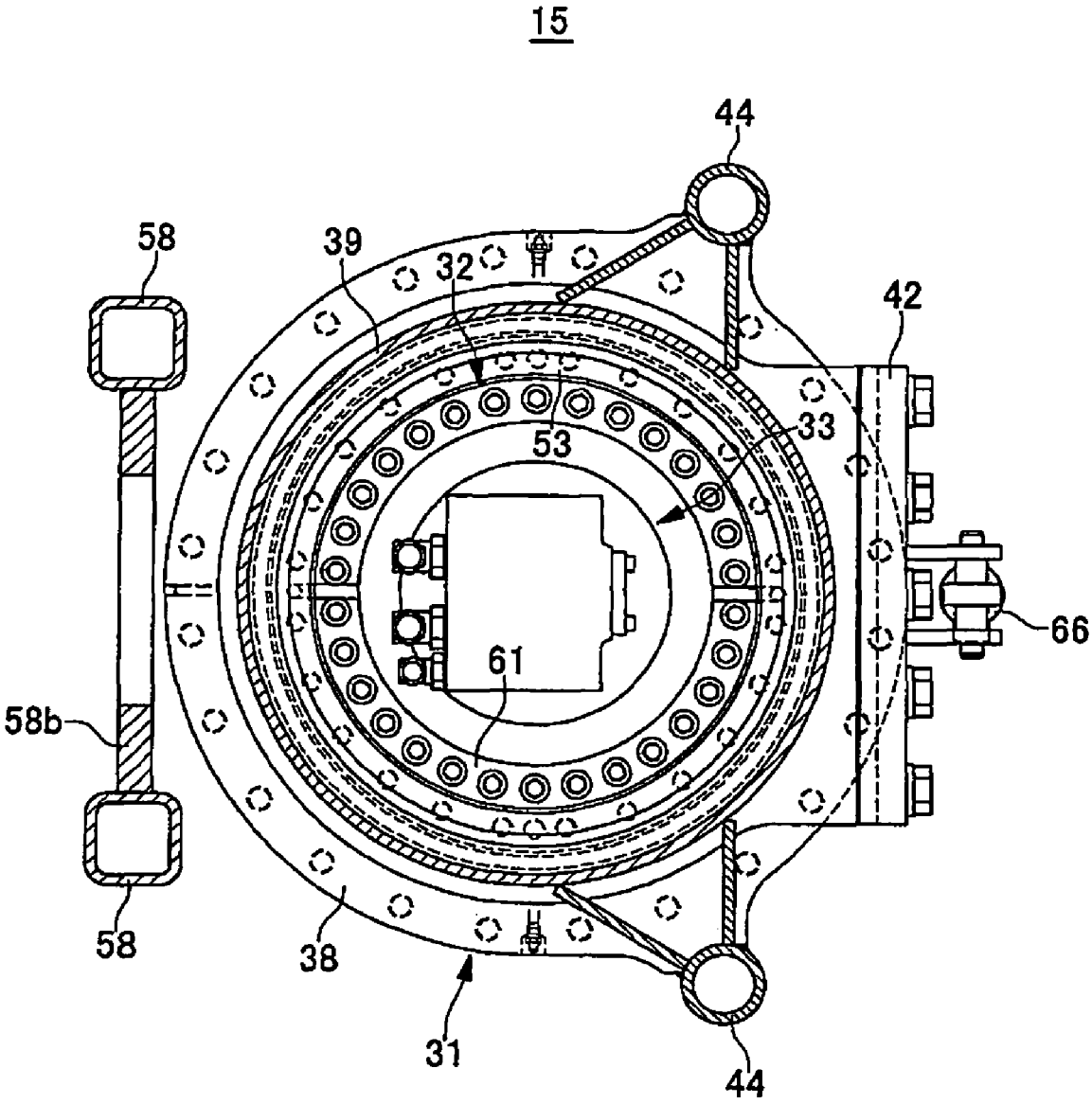
FIG. 5 is a cross-sectional view taken along the line 5-5 in FIG. 2.

As shown in FIGS. 2 and 3, the leader revolver 15 includes: a fixed-side outer tube 31 connected to the base machine 13 via the subleader 14; a rotation-side inner tube 32 concentrically arranged inside the fixed-side outer tube 31; a hydraulic motor 33 placed in a lower part of the leader revolver 15; and a locking device 34 for locking rotation of the leader 17. One pair of tapered roller bearings 35 and 36 are disposed at two upper and lower positions between the fixed-side outer tube 31 and the rotation-side inner tube 32, as bearings which rotatably hold both tubes. These tapered roller bearings 35 and 36 can receive a load exerted on the rotation-side inner tube 32.

The fixed-side outer tube 31 includes: an upper ring member 37 located on an outer periphery side of the upper tapered roller bearing 35; a lower ring member 38 located on an outer periphery side of the lower tapered roller bearing 36; an outer cylindrical member 39 located between the upper ring member 37 and the lower ring member 38; a ring-shaped motor engagement member 40 provided under the lower ring member 38; a lower bearing holder 41 provided under the motor engagement member 40; a bracket 43 protruding from the rear side of the outer cylindrical member 39 via a support plate 42; and guide-bar/supports 44 corresponding to the guide bars 24 of the leader 17. One pair of left and right guide gibs 45 protruding forward from the subleader 14 engage with the corresponding guide-bar/supports 44, as a result of which the fixed-side outer tube 31 is held in a state of being non-rotatable about the axis and in a state of being slidable in the axial direction. The position of the leader 17 in the axial direction is determined by a leader slide cylinder 46 which is disposed between the subleader 14 and the bracket 43. A cylindrical bottom leader holder 48 is provided at the bottom of the lower bearing holder 41 via a radial ball bearing 47 which is a bearing member, so as to be rotatable about the axis.

The rotation-side inner tube 32 includes: a cylindrical upper rotation member 51 located on an inner periphery side of the upper tapered roller bearing 35; a lower rotation member 52 located on an inner periphery side of the lower tapered roller bearing 36; and an inner cylindrical member 53 located between the upper rotation member 51 and the lower rotation member 52. Around an upper part of the upper rotation member 51 protruding upward from inside the upper ring member 37 of the fixed-side outer tube 31, an upper leader connector 55 that is connected by a serration joint 54 so as to rotate integrally is provided and fixed by a retainer plate 56.

The upper leader 17*a* has a lower flange member 57 at the bottom, which is bolt-connected to a connection flange 55*a* of the upper leader connector 55. Upper ends 58*a* of guide connectors 58 corresponding to the guide member 21 are fixed to the front of the upper leader connector 55 via a connection plate 58*b*. Lower ends 58*c* of the guide connectors 58 are fixed to the front of the bottom leader holder 48. The bottom leader 17*b* has an upper flange member 59 at the top, which is attached to a connection flange 48*a* formed at a lower end of the bottom leader holder 48.

The hydraulic motor 33 is a general-purpose hydraulic motor including a speed reducer and a negative brake, and has a casing flange (fixed flange) 61 and a rotary case flange (movable flange) on its periphery. The fixed flange 61 and the movable flange 62 are set to rotate relatively in opposite directions by a hydraulic pressure supplied from a hydraulic circuit 33*a*. In this embodiment, the fixed flange 61 is integrally connected to the lower rotation member 52 in the rotation-side inner tube 32 by bolt connection, and the movable flange is connected to the motor engagement member 40 in the fixed-side outer tube 31 by projection-depression engagement.

Figure 6:
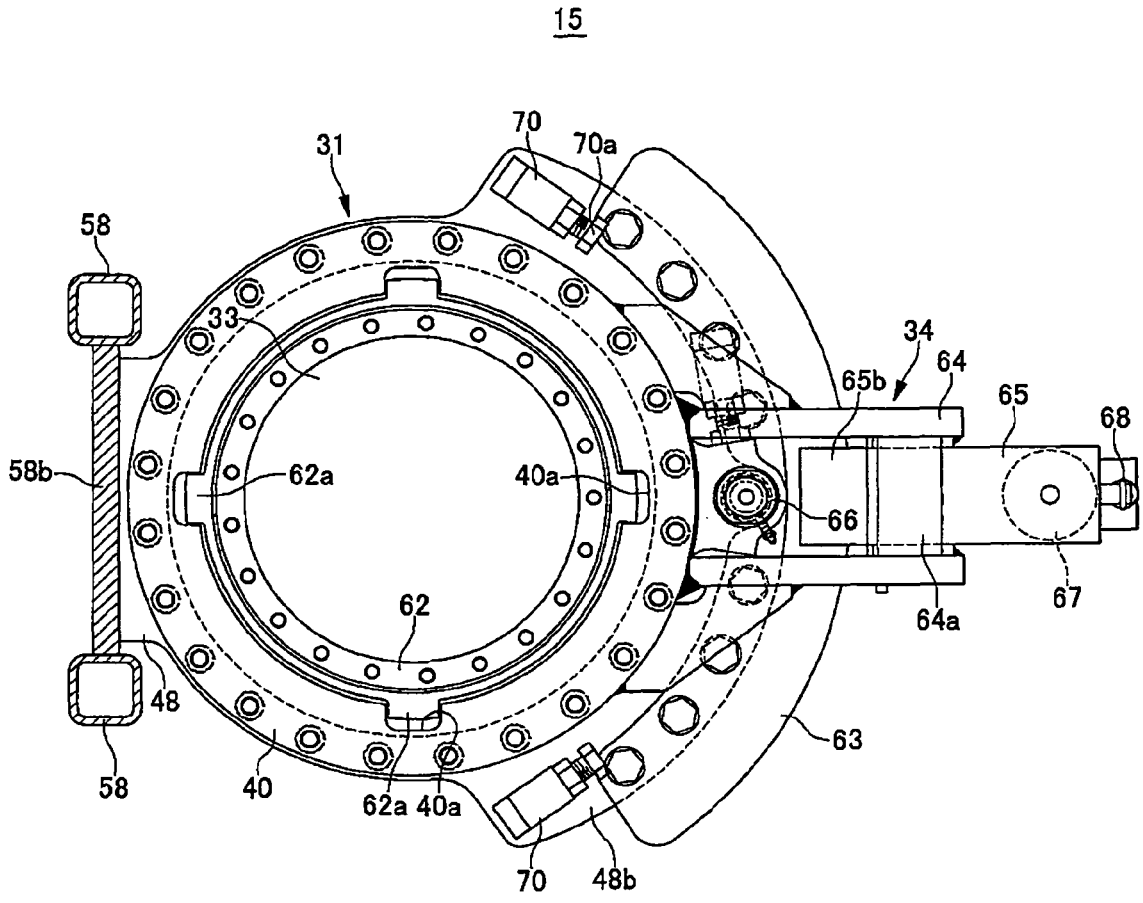
FIG. 6 is a cross-sectional view taken along the line 6-6 in FIG. 2.
Figure 7:
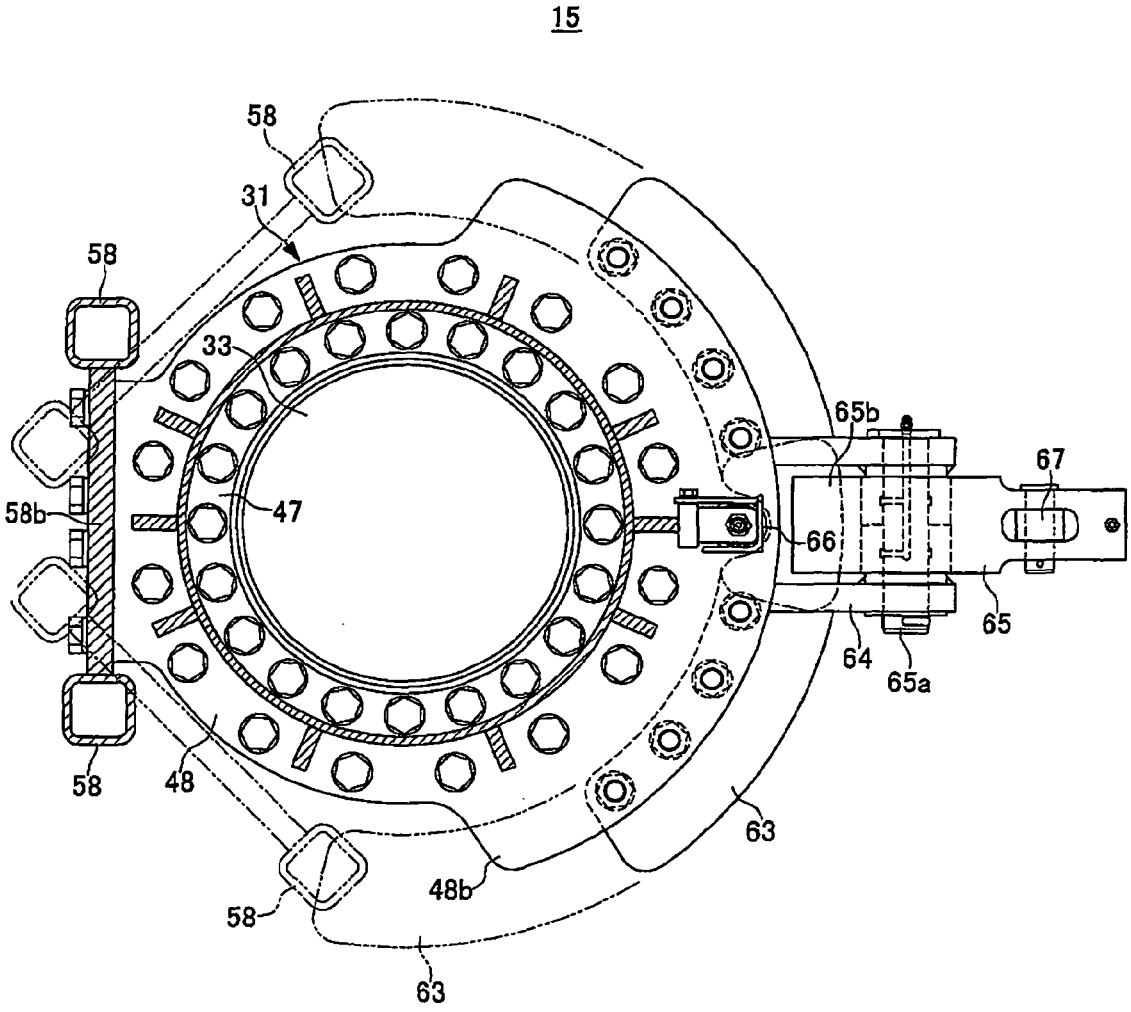
FIG. 7 is a cross-sectional view taken along the line 7-7 in FIG. 3.

Specifically, as shown in FIG. 6, four engaging depressions 40*a* are formed on an inner periphery of the ring-shaped motor engagement member 40 with intervals of 90 degrees, and four engaging projections 62*a* corresponding to the engaging depressions 40*a* are formed on an outer periphery of the movable flange 62 of the hydraulic motor 33. By engaging each of the engaging projections 62*a* of the movable flange 62 with the corresponding one of the engaging depressions 40*a* of the motor engagement member 40 while leaving slight clearance therebetween, the rotation-side inner tube 32 is connected to the hydraulic motor 33 in a state of being freely movable in the axial direction with only the movement in the rotation direction being restricted The locking means 34 includes: a fan-shaped disc 63 fixed to a semicircular flared portion 48*b* which spreads from the rear side of the bottom leader holder 48; a lock bracket 64 protruding from the rear side of the fixed-side outer tube 31 and having a reinforcement plate 64*a*; one pair of chucks 65 attached to the lock bracket 64 by a rotation shaft 65*a*; and a lock cylinder 66 for fixing the disc 63 in a reference position. The lock cylinder 66 fixes the leader 17 in place to prevent rotation by engaging a cylinder rod with an engaging hole (not illustrated) formed in the flared portion 48*b* and the disc 63, when the leader 17 stays in place with its front facing the guide member 21, that is, in a state where the guide member 21 faces forward when the leader 17 is in a standing position and faces upward when the leader 17 is in a laying position.

The chucks 65 have a revolver clamp cylinder and an opening spring 68 for opening/closing a disc clamping portion 65*b* at the tip. When the revolver clamp cylinder 67 is not operating (retracted), a restoring force of the opening spring in a compression direction opens the disc clamping portion 65*b* and brings the disc 63 into a rotatable state. By actuating the revolver clamp cylinder 67 to extend, the disc clamping portion 65*b* is closed to clamp the disc 63, thereby bringing the disc 63 into a rotation locked state. In this way, the rotation of the leader 17 can be controlled in an arbitrary position.

Stoppers 70 for restricting the rotation range of the bottom leader holder 48, that is, the rotation range of the leader 17, by contacting a contact portion 69 formed at the bottom of the lock bracket 64 are provided at both circumferential ends of the flared portion 48*b*, in a state where the extent of protrusion of corresponding contact bolts 70*a* is fine-adjustable.

The leader revolver 15 formed in this way is configured such that the rotation-side inner tube 32 is rotatably placed, via one pair of upper and lower tapered roller bearings 35 and 36, inside the fixed-side outer tube 31 which is non-rotatably held by the guide gibs 45 of the subleader 14, and the leader 17 (upper leader 17*a*) is supported by this rotation-side inner tube 32. Accordingly, a moment load applied from the leader 17 can be received by the tapered roller bearings 35 and 36. Thus, the leader 17 can be reliably held by the leader revolver 15 in a rotatable state.

The hydraulic motor 33, which is fixed to the rotation-side inner tube 32, has the movable flange 62 engaging with the motor engagement member 40 of the fixed-side outer tube 31 by projection-depression engagement, thereby connecting the movable flange 62 and the motor engagement member 40 in a state of being freely movable in the axial direction. Therefore, even when a large moment load is applied from the leader 17 onto the rotation-side inner tube 32 and causes the rotation-side inner tube 32 to tilt, the movable flange 62 can freely tilt with respect to the motor engagement member 40, so that the moment load does not act between the fixed flange 61 and the movable flange 62 of the hydraulic motor 33. Since the hydraulic motor 33 is not required to have a special strength, a general-purpose hydraulic motor can be used.

When rotating the leader 17, the leader 17 is brought into a rotatable state by making the lock cylinder 66 and the revolver clamp cylinder 67 inactive, and the hydraulic motor 33 is hydraulically actuated to rotate in a predetermined direction. Since the movable flange 62 is held by the fixed-side outer tube 31 in a rotation restricted state, the fixed flange 61 rotates relative to the movable flange 62, and the rotation-side inner tube 32 rotates via the lower rotation member 52 to which the fixed flange 61 is fixed. Via the lower flange member 57 which is connected to this rotation-side inner tube 32 by the serration joint 54 in an integrally rotatable state, the upper leader 17*a* rotates in the predetermined direction together with the fixed flange 61 and the rotation-side inner tube 32. Moreover, the guide connectors 58 fixed to the front of the upper leader connector 55 rotate with the upper leader 17*a*, and the bottom leader holder 48 connected to the guide connectors 58 rotates via the radial ball bearing 47. As a result, the bottom leader 17*b* also rotates in the same direction.

Thus, by rotating the rotation-side inner tube 32 by the hydraulic motor 33, the upper leader 17*a* and the bottom leader 17*b* can be rotated in the predetermined direction. Here, the guide member 21 and the guide connectors 58 also rotate simultaneously, so that the guide member 21 is connected to the front of the upper leader 17*a*, the bottom leader 17*b*, and the leader revolver 15 regardless of a rotation angle of the leader 17. Accordingly, the working device 20 can be moved vertically along the entire length of the leader 17.

On the other hand, when the hydraulic actuation of the hydraulic motor 33 is stopped at an arbitrary rotation angle, the negative brake in the hydraulic motor 33 operates to restrict the rotation of the hydraulic motor 33. Further, by actuating the revolver clamp cylinder 67 to clamp the disc 63 with the chucks 65 to thereby restrict the rotation of the bottom leader holder 48, even when a rotary torque from the working device 20 or the like acts on the leader 17, it is possible to prevent the leader 17 from rotating. In particular, through the use of the hydraulic motor 33 including a typical negative brake, the rotation of the leader 17 can be restricted by a small force as compared with the case of restricting the rotation of the leader 17 using only the locking device. Since this enables the force of clamping the disc 63 by the chucks 65 to be reduced, it is possible to simplify and downsize the locking means 34.

When horizontally lowering the leader 17 for transportation of the pile driver 11, in a state where the leader 17 is set in place by actuating the hydraulic motor 33 as mentioned above, the lock cylinder 66 is actuated to fix the leader 17 in a non-rotatable state. In this fixed state, the guide-bar/support 44 and the guide bar 24 are collinear, and the guide gib 45 is movable to the guide-bar/support 44 and the guide bar 24. Accordingly, the leader slide cylinder 46 is actuated to slide the guide gib 45 from the guide-bar/support 44 to the guide bar 24, thereby moving the leader 17 in the axial direction. Thus, the weight and length of the leader 17 can be balanced in transportation.

In such a large pile driver 11 in which the leader 17 is mounted movably in the axial direction via the subleader 14, a reactive force exerted on the leader 17 from the working device 20 during operation largely acts on the leader revolver 15 as a bending moment. According to the above structure of the leader revolver 15, however, the leader 17 can be reliably held in a state of being rotatable about the axis. Moreover, the hydraulic motor 33 can be protected because the moment load does not act on the hydraulic motor 33.

In the above embodiment, each part of the leader revolver 15 is divided into a plurality of members in consideration of manufacturability and assemblability. Welding connection is adopted for a part not requiring assembly/disassembly while detachable connection using bolts is adopted for a part requiring assembly/disassembly, with reinforcing members being provided according to need. However, the shape and placement of each member can be appropriately selected in accordance with the size and required strength of the leader revolver 15, and are not limited to the above embodiment.

In addition, if a rotating torque does not act on the leader 17, the rotation of the leader 17 can be suppressed by the negative brake in the hydraulic motor 33, with it being possible to omit the locking device 34. Moreover, the bottom leader 17*b* may be omitted so that the leader 17 is made up of only the upper leader 17*a* above the leader revolver 15. Furthermore, for example the hydraulic motor 33 may be turned upside down to connect the fixed flange 61 to the fixed-side outer tube 31 and the movable flange 62 to the rotation-side inner tube 32.

Figure 8:
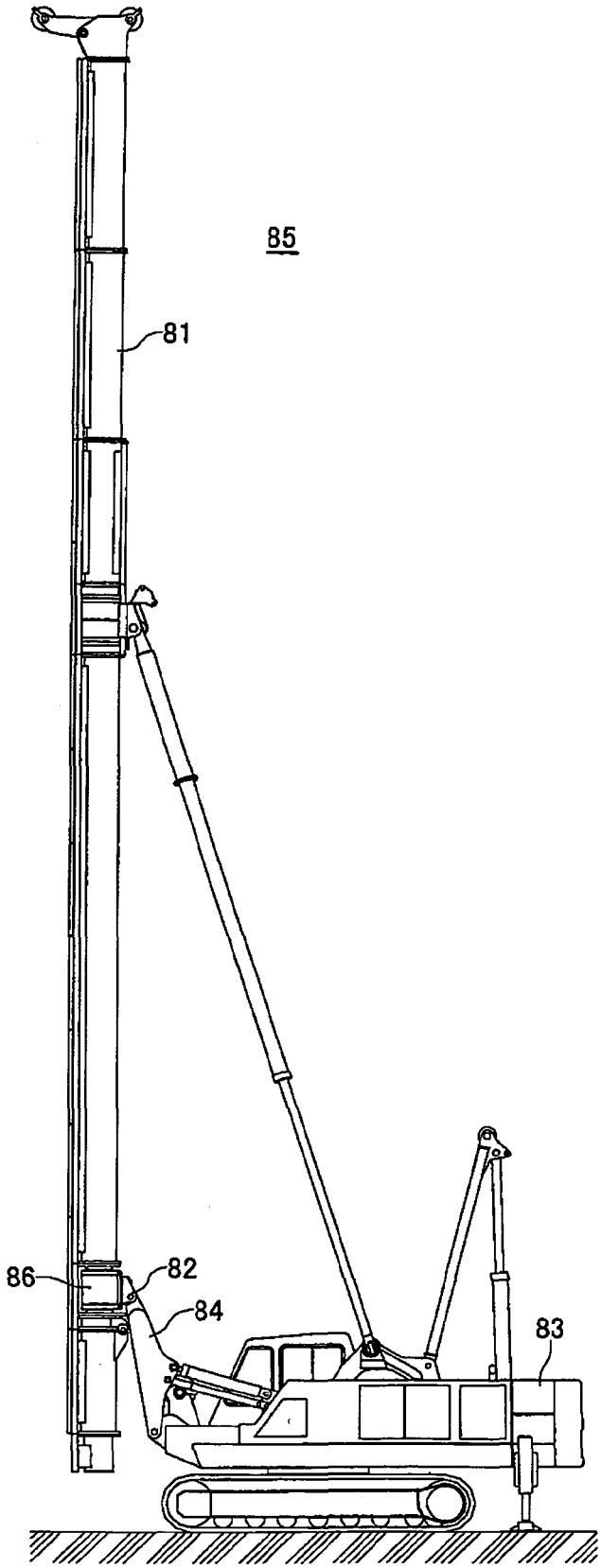
FIG. 8 is a schematic side view showing another embodiment of the pile driver according to the present invention.
Figure 9:
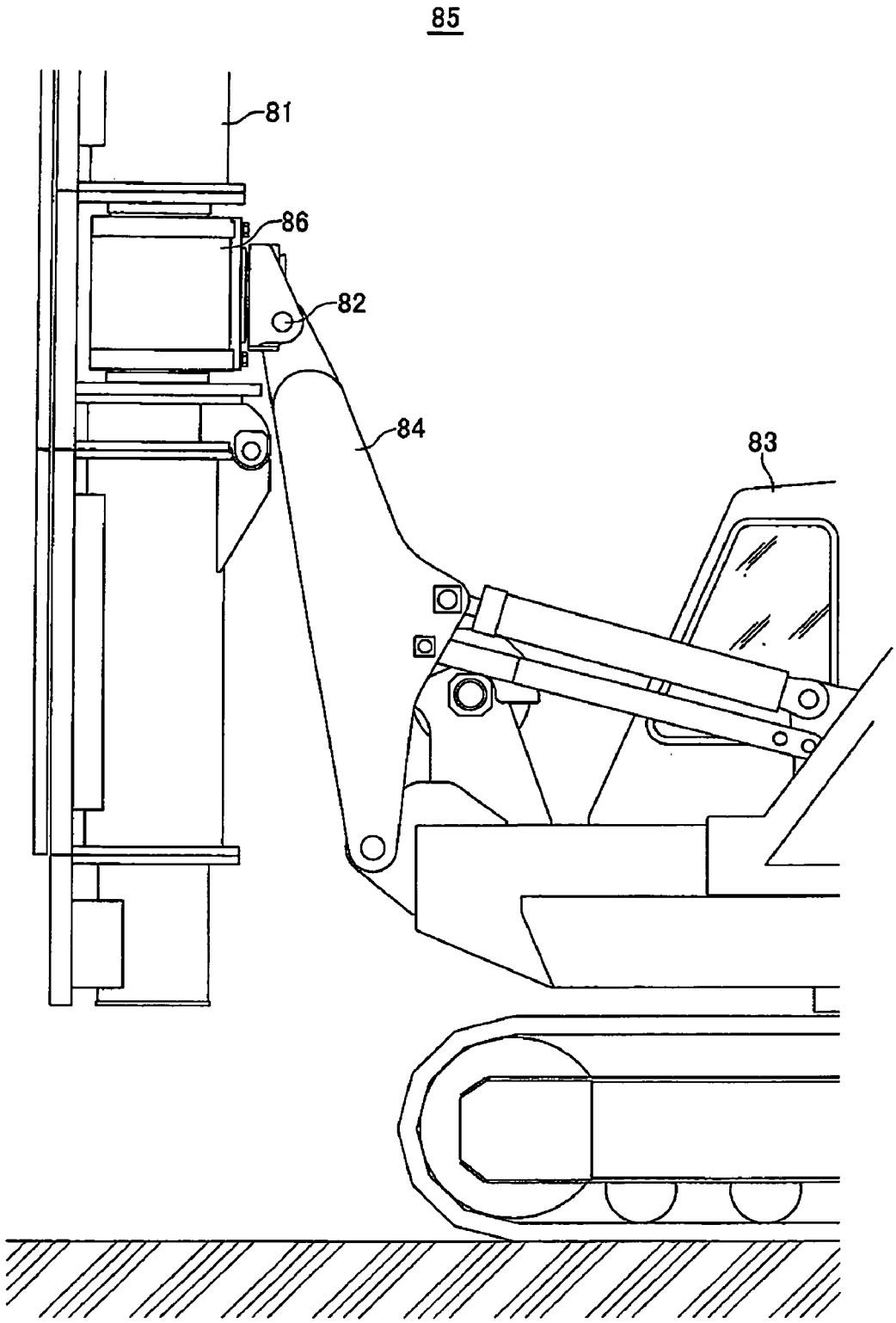
FIG. 9 is a side view of the relevant part of the pile driver shown in FIG. 8.

The present invention is not limited to the pile driver 11 in which the leader 17 is supported via the subleader 14 as shown in the above embodiment. The present invention is also applicable to a pile driver 85 in which a main shaft provided at the rear side of a leader 81 is supported and connected to a base machine 83 by an arm 84 as shown in the schematic side view of FIG. 8 and the relevant part of the side view of FIG. 9, where a moment load from a working device attached to the leader 81 acts on the leader revolver 86.

What is claimed is:

1. A pile driver comprising:

a base machine;

a leader held at a front part of the base machine rotatably about an axis; and a leader revolver provided to the base machine, the leader revolver having a rotation means of rotatably holding the leader and also rotating the leader, wherein the leader revolver comprises:

an outer tube that is fixed or non-rotating connected to the base machine side;

a rotating inner tube concentrically arranged inside the outer tube via a pair of bearings which are disposed at two upper and lower positions; and a hydraulic motor arranged at a lower part of the leader revolver, a lower part of the leader being connected, in an integrally rotatable state, to an upper part of the rotating inner tube that protrudes upward from an opening at an upper end of the outer tube, and one of a fixed flange and a movable flange of the hydraulic motor being connected to a lower part of the rotating inner tube, and the other one of the fixed flange and the movable flange being connected to a lower part of the outer tube.

2. The pile driver according to claim 1, wherein a bottom leader holder that holds a bottom leader in a state of being rotatable about an axis is provided at a lower part of the outer tube via a bearing member, and the leader and the bottom leader holder are connected to each other by a guide pipe in an integrally rotatable state.

3. The pile driver according to claim 2, wherein the bottom leader holder is provided with a disc that integrally rotates with the bottom leader holder, and a locking means that locks rotation of the disc by clamping the disc is disposed at a lower part of the outer tube.

4. The pile driver according to claim 3, wherein the leader revolver is supported on the base machine via a subleader that is provided on a base machine side of the leader in parallel with the leader.

5. The pile driver according to claim 3, wherein a main shaft provided on a rear side of the leader of the leader revolver is supported by an arm that is formed on the base machine.

6. The pile driver according to claim 2, wherein the leader revolver is supported on the base machine via a subleader that is provided on a base machine side of the leader in parallel with the leader.

7. The pile driver according to claim 2, wherein a main shaft provided on a rear side of the leader of the leader revolver is supported by an arm that is formed on the base machine.

8. The pile driver according to claim 1, wherein the connection between the flange of the hydraulic motor and the lower part of the outer tube is made by projection-depression engagement of a plurality of circumferentially formed projections and depressions.

9. The pile driver according to claim 8, wherein the leader revolver is supported on the base machine via a subleader that is provided on a base machine side of the leader in parallel with the leader.

10. The pile driver according to claim 8, wherein a main shaft provided on a rear side of the leader of the leader revolver is supported by an arm that is formed on the base machine.

11. The pile driver according to claim 1, wherein the hydraulic motor include a negative brake.

12. The pile driver according to claim 11, wherein the leader revolver is supported on the base machine via a subleader that is provided on a base machine side of the leader in parallel with the leader.

13. The pile driver according to claim 11, wherein a main shaft provided on a rear side of the leader of the leader revolver is supported by an arm that is formed on the base machine.

14. The pile driver according to claim 1, wherein the leader revolver is supported on the base machine via a subleader that is provided on a base machine side of the leader in parallel with the leader.

15. The pile driver according to claim 1, wherein a main shaft provided on a rear side of the leader of the leader revolver is supported by an arm that is formed on the base machine.

* * * * *